US010392898B2

(12) United States Patent
Giroux et al.

(10) Patent No.: US 10,392,898 B2
(45) Date of Patent: Aug. 27, 2019

(54) MECHANICALLY OPERATED REVERSE CEMENTING CROSSOVER TOOL

(71) Applicant: Weatherford Technology Holdings, LLC, Houston, TX (US)

(72) Inventors: Richard L. Giroux, Cypress, TX (US); Eric R. Evans, Magnolia, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 444 days.

(21) Appl. No.: 15/184,885

(22) Filed: Jun. 16, 2016

(65) Prior Publication Data

US 2017/0362915 A1 Dec. 21, 2017

(51) Int. Cl.

| | |
|---|---|
| ***E21B 33/14*** | (2006.01) |
| ***E21B 34/08*** | (2006.01) |
| ***E21B 34/06*** | (2006.01) |
| ***E21B 34/00*** | (2006.01) |
| ***E21B 34/10*** | (2006.01) |
| ***E21B 43/10*** | (2006.01) |
| ***E21B 43/04*** | (2006.01) |

(52) U.S. Cl.

CPC ..... *E21B 34/08* (2013.01); *E21B 33/14* (2013.01); *E21B 34/063* (2013.01); *E21B 34/103* (2013.01); *E21B 43/045* (2013.01); *E21B 43/10* (2013.01); *E21B 2034/002* (2013.01)

(58) Field of Classification Search

CPC ..... E21B 34/08; E21B 33/14; E21B 34/063; E21B 34/103; E21B 43/045; E21B 43/10; E21B 2034/002

See application file for complete search history.

(56) References Cited

U.S. PATENT DOCUMENTS

| | | | |
|---|---|---|---|
| 7,252,152 | B2 | 8/2007 | LoGiudice et al. |
| 8,286,717 | B2 | 10/2012 | Giroux et al. |
| 8,403,078 | B2 | 3/2013 | Brunnert et al. |
| 2002/0036087 | A1 | 3/2002 | Bixenman et al. |
| 2004/0084182 | A1 | 5/2004 | Edgar et al. |
| 2012/0279705 | A1 | 11/2012 | Moffitt |
| 2013/0264068 | A1 | 10/2013 | Hanson et al. |

(Continued)

FOREIGN PATENT DOCUMENTS

| | | | |
|---|---|---|---|
| GB | 1063977 | A | 4/1967 |
| WO | 2014/169166 | A2 | 10/2014 |
| WO | 2015/038119 | A1 | 3/2015 |

OTHER PUBLICATIONS

PCT International Search Report and Written Opinion dated Aug. 4, 2017, for International Application No. PCT/US2017/035108.

*Primary Examiner* — Zakiya W Bates
*Assistant Examiner* — Crystal J Miller
(74) *Attorney, Agent, or Firm* — Patterson + Sheridan, LLP

(57) ABSTRACT

A crossover tool for use in a wellbore includes: a tubular housing having a bypass port; a mandrel having a bore therethrough and a mandrel port in fluid communication with the mandrel bore, the mandrel movable relative to the tubular housing between a first position where the mandrel port is isolated from the bypass port and a second position where the mandrel port is aligned with the bypass port; and an actuator operable to move the mandrel between the first position and the second position. The actuator includes a first piston connected to the mandrel and a second piston operable in response to the first piston.

20 Claims, 7 Drawing Sheets

(56) References Cited

U.S. PATENT DOCUMENTS

| | | | | |
|---|---|---|---|---|
| 2013/0319767 | A1 | 12/2013 | Wilson et al. | |
| 2014/0305662 | A1* | 10/2014 | Giroux | E21B 33/14 166/386 |
| 2015/0176367 | A1 | 6/2015 | Hern et al. | |
| 2016/0024876 | A1 | 1/2016 | Ward et al. | |

* cited by examiner

MECHANICALLY OPERATED REVERSE CEMENTING CROSSOVER TOOL

BACKGROUND OF THE INVENTION

Field of the Invention

This disclosure relates to mechanically operated tools for cementing a liner string.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing or liner in a wellbore. In this respect, the well is drilled to a first designated depth with a drill bit on a drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be hung off of the existing casing. The second casing or liner string is then cemented. This process is typically repeated with additional casing or liner strings until the well has been drilled to total depth. In this manner, wells are typically formed with two or more strings of casing/liner of an ever-decreasing diameter.

One type of cementing systems involves conventional circulation of cement through the inner diameter of the liner string and up through the annular area behind the liner string. A second type of cementing system provides for switching between conventional circulation of drilling fluids during drilling of the well and reverse circulation during cementing of the liner string. However, one type of reverse cementing systems requires complex electrical triggers to switch between the conventional and reverse circulation modes. The complex system is ideal for some applications, but for a simple cementing job it may be too complex. Therefore, what is needed is a mechanical method of switching between the conventional and reverse circulation modes for cementing a liner string.

SUMMARY OF THE INVENTION

A crossover tool for use in a wellbore includes: a tubular housing having a bypass port; a mandrel having a bore therethrough and a mandrel port in fluid communication with the mandrel bore, the mandrel movable relative to the tubular housing between a first position where the mandrel port is isolated from the bypass port and a second position where the mandrel port is aligned with the bypass port; and an actuator operable to move the mandrel between the first position and the second position. The actuator includes: a first piston connected to the mandrel; and a second piston operable in response to the first piston.

The mandrel further includes a first seat operable to actuate the actuator. The crossover tool also includes a second mandrel having a bore therethrough and connected to the second piston, and a second seat connected to the second mandrel and operable to actuate the actuator. The first and second seats are configured to receive an obturating member. The second piston is movable in a direction opposite of a direction of the first piston. The first and second seats include a seat stack having one or more seats. An inner diameter of the first seat is smaller than an inner diameter of the second seat. The mandrel further includes a mandrel bypass port and the mandrel bypass port is aligned with the bypass port of the tubular housing when the mandrel is in the first position. The mandrel bypass port is in fluid communication with a bypass passage of the mandrel.

A crossover tool for use in a wellbore includes: a tubular housing having a bypass port; a first mandrel having a bore therethrough. The first mandrel includes a mandrel port, a first seat, a first piston movable in a first direction between a first position where the mandrel port is isolated from the bypass port and a second position where the mandrel port is aligned with the bypass port and movable in response to the first seat receiving a first fluid blocking member. The crossover tool also includes a second mandrel having a bore therethrough and including a second seat, and a second piston movable in a second direction in response to the first piston.

A method for cementing a liner string in a wellbore includes running a liner string and a crossover tool into the wellbore, the crossover tool including: a first seat, a first mandrel having a first piston and a mandrel port, and a second piston. The method also includes landing a first obturating member in the first seat, supplying pressure to a bore of the crossover tool to move the first piston, and moving the second piston in response to movement of the first piston. The method also includes shifting the crossover tool from a first position to a second position in response to landing the first obturating member in the first seat, wherein the mandrel port is isolated from a bypass port in the first position and the mandrel port is aligned with the bypass port in the second position. The method also includes pumping cement through the crossover tool and into an annulus between the liner string and the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
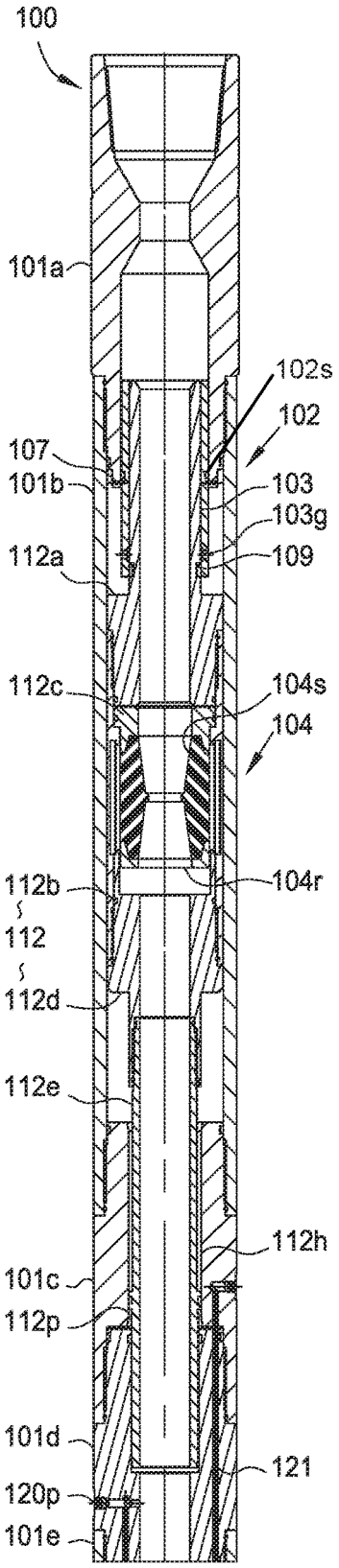
FIGS. 1A-1D illustrate a crossover tool, according to one embodiment of this disclosure.
Figure 1B:
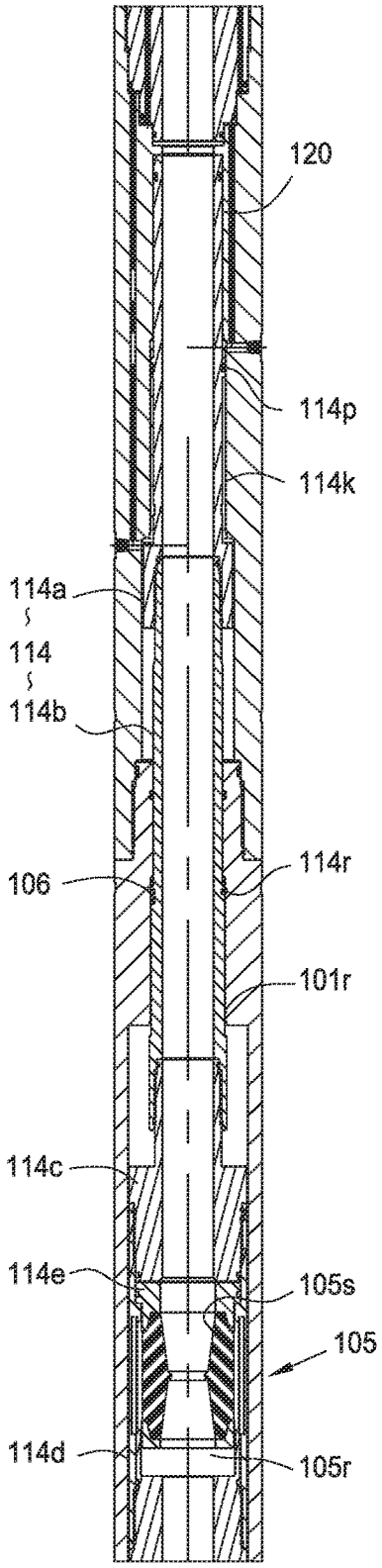
Figure 1C:
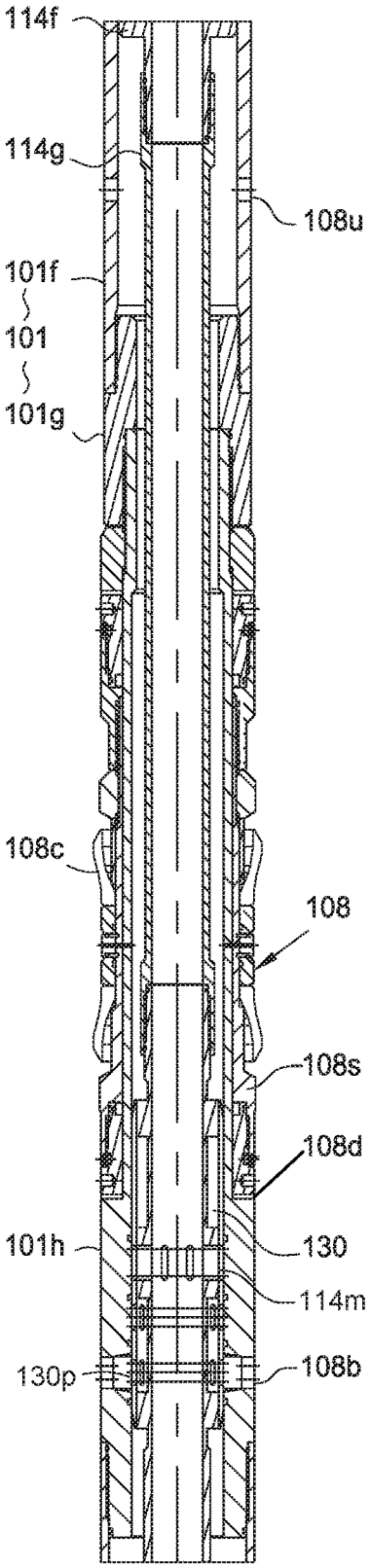
Figure 1D:
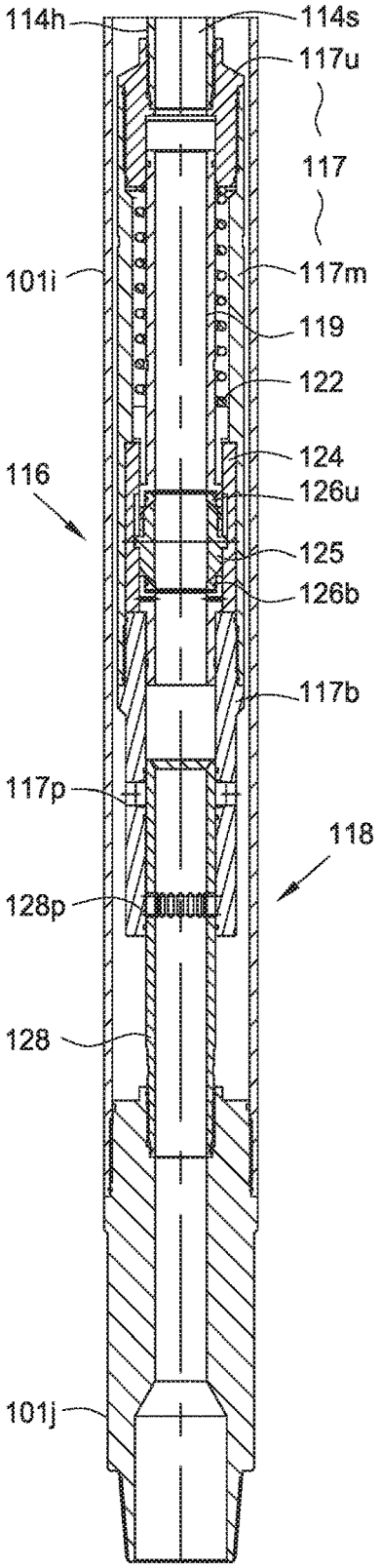
Figure 1E:
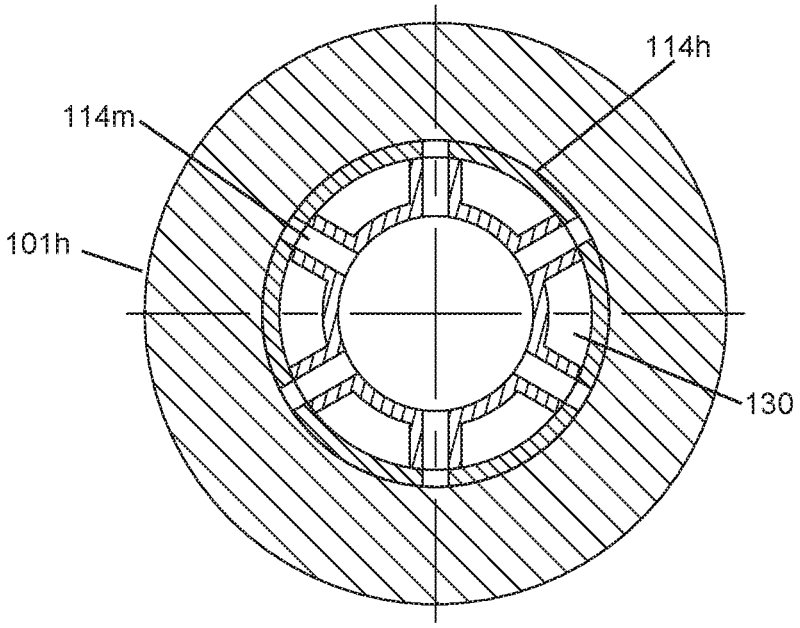
FIG. 1E illustrates a sectional view of a crossover tool through a bypass port, according to one embodiment of this disclosure.

The crossover tools 100, 200 may be part of a liner deployment assembly ("LDA"), as disclosed in U.S. Patent Application Publication No. 2014/0305662, filed on Apr. 10, 2014, the portions of the specification describing and illustrating the various types of LDA are incorporated herein by reference. In one example, the LDA includes a circulation sub, the crossover tools 100, 200, a flushing sub, a setting tool, a liner isolation valve, a latch, and a stinger. The LDA members may be connected to each other, such as by threaded couplings. The LDA may be deployed with a liner string and operated to cement the liner string in the wellbore. The crossover tools 100, 200 may be disposed in an inner diameter of a casing string. The crossover tools 100, 200 may be run into the casing string in the same manner as described in the above-referenced patent application. Crossover tools 100, 200 are operated in a conventional bore position, where fluid is pumped from the surface down through a bore of the crossover tool 100, 200 and continues through the LDA to a formation of the wellbore. Fluid returns travel up an annulus between the casing string and the crossover tool 100, 200 before entering lower bypass ports and exiting upper bypass ports of the crossover tool 100, 200. The crossover tools 100, 200 may be shifted into a reverse bore position to cement the liner string in the wellbore. After shifting the crossover tool 100, 200 to the reverse bore position, cement is pumped from the surface down to the crossover tool 100, 200. The cement exits the crossover tool 100, 200 through mandrel ports and enters the annulus between the casing string and the crossover tool. The cement continues down through the annulus to cement the liner string in the wellbore.

FIGS. 1A-1D illustrate the crossover tool 100 in a conventional bore position. The crossover tool may include a housing 101, a lock mechanism 102, a first seat 104, a second seat 105, a rotary seal 108, a first mandrel 112, a second mandrel 114, a bore valve 116, and a stem valve 118. The housing may include two or more tubular sections 101*a-j* connected to each other, such as by threaded couplings. The housing 101 may have a coupling, such as a threaded coupling, formed at upper and lower longitudinal ends thereof for connection to a section of drill pipe. The housing sections 101*c-e* may have channels 120, 121 formed in a wall thereof for passage of hydraulic fluid. The channel 120 may be in fluid communication with a port 120*p* formed in a wall of the housing 101. The port 120*p* may permit fluid communication between a bore of the crossover tool 100 and the channel 120.

The first mandrel 112 may be disposed in a bore of the housing 101. The first mandrel 112 may include two or more tubular sections 112*a-e* connected to each other, such as by threaded couplings. A first piston chamber 112*h* is formed in an annulus between the first mandrel section 112*e* and the housing 101, such as housing section 101*c*. The first mandrel section 112*e* may have a piston 112*p* formed on an outer wall thereof. The piston 112*p* may divide the piston chamber 112*h* into an upper and lower section. The lower section may be in fluid communication with the channel 121. The piston 112*p* moves longitudinally within the piston chamber 112*h*. The first mandrel 112 moves longitudinally within the housing 101 due to the connection to the piston 112*p*. A shoulder of the housing section 101*d* and a shoulder of a sleeve 103 act as stops to prevent further longitudinal movement of the first mandrel 112. The first mandrel 112 is movable with the piston 112*p* between a first position (FIG. 1A, 2A), where the shoulder of housing section 101*d* prevents further longitudinal movement of the first mandrel 112 downward through the bore of the housing 101, and a second position (FIG. 3A), where the shoulder of the sleeve 103 prevents further longitudinal movement of the first mandrel 112 upward through the bore of the housing 101.

The second mandrel 114 may be disposed in the bore of the housing 101. The second mandrel 114 may include two or more tubular sections 114*a-h* connected to each other, such as by threaded couplings. A second piston chamber 114*k* is formed in an annulus between the second mandrel section 114*a* and the housing 101, such as housing section 101*e*. The second mandrel section 114*a* may have a piston 114*p* formed on an outer wall thereof. The piston 114*p* may divide the piston chamber 114*k* into an upper and lower section. The upper section may be in fluid communication with the channel 120. The lower section may be in fluid communication with the channel 121. The piston 114*p* moves longitudinally within the piston chamber 114*k*. The second mandrel 114 moves longitudinally within the housing 101 due to the connection to the piston 114*p*. An upper end of a stem 128 and a lower shoulder of housing section 101*e* act as stops to prevent further longitudinal movement of the second mandrel 114. The second mandrel 114 is movable with the piston 114*p* between a first position (FIG. 1A, 2A), where the shoulder of housing section 101*e* prevents further longitudinal movement of the second mandrel 114 upward through the bore of the housing 101, and a second position (FIG. 3A), where the upper end of the stem 128 prevents further longitudinal movement of the second mandrel 114 downward through the bore of the housing 101. The second mandrel section 114*b* may have one or more grooves 114*r* formed in an outer wall thereof. The housing section 101*f* may have one or more complementary grooves 101*r*. A retainer 106 may be disposed in the one or more grooves 114*r*, 101*r*. The retainer 106 may couple the second mandrel 114 to the housing section 101*f* when disposed in the one or more grooves 114*r*, 101*r*. The retainer 106 may be longitudinally movable with the second mandrel section 114*b* between the one or more grooves 114*r*, 101*r*. The retainer 106 may be a coiled spring. A bypass passage 130 may be formed in a wall of the second mandrel section 114*h*. The second mandrel section 114*h* may have mandrel ports 114*m* and bypass ports 130*p* formed in a wall thereof. The bypass ports 130*p* may provide fluid communication between the bypass passage 130 and an outer annulus surrounding the housing 101 below the rotary seal 108. The mandrel ports 114*m* may provide fluid communication between a bore 114*s* of the second mandrel 114 and the outer annulus between the crossover tool 100 and the casing string.

Figure 3A:
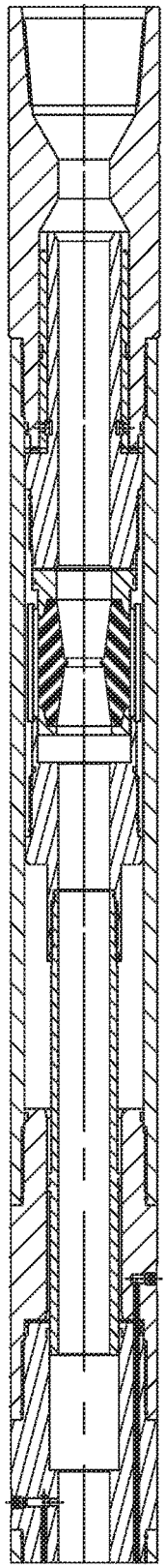
FIGS. 3A-3D illustrate shifting of the crossover tool into a reverse bore position.

The lock mechanism 102 may include the sleeve 103, the first mandrel section 112*a*, and lock rings 102*s*, 109. The sleeve 103 may be disposed in a bore of the housing 101 and coupled to the housing section 101*a* by shear member(s), such as shear pin(s) 107. The first mandrel section 112*a* may have a recess formed in an outer surface. The lock ring 109 may be seated in the recess. The sleeve 103 may have a groove 103*g* formed in a wall thereof for receiving the lock ring 109. The lock ring 109 may be configured to expand when moved into alignment with the groove 103*g*, coupling the sleeve 103 to the first mandrel 112. The sleeve 103 may have hole(s) formed in an outer surface, aligned with the groove 103*g*. The hole(s) may be threaded to receive set screw(s) (not shown). The set screw(s) may be screwed into the hole(s) to recompress the lock ring 109 back into the recess. The lock ring 102*s* may be disposed in a second groove formed through the wall of the sleeve 103 above the lock ring 109. The first mandrel 112 may be longitudinally movable relative to the housing 101 between a lower position (FIG. 1A) and an upper position (FIG. 3A). In the lower position, the first mandrel section 112*e* may abut a shoulder of the housing section 101*d*. The shoulder prevents further longitudinal movement of the first mandrel 112 in the direction of the bore valve 116. In the upper position, a shoulder of the first mandrel section 112*a* may abut a shoulder of the housing section 101*a*. The sleeve 103 may be longitudinally movable relative to the housing 101 between a first position (FIG. 1A) where the sleeve 103 is coupled to the housing section 101*a* by the shear pins 107, a second position where the sleeve 103 is coupled to the first mandrel section 112*a* by the lock ring 109 and the shear pins 107 have been fractured, and a third position (FIG. 3A) where the sleeve 103 is longitudinally movable relative to the housing 101 with the first mandrel 112.

The first seat 104 is disposed in a recess 104*r* formed in the first mandrel section 112*c*. The first seat 104 is movable with the first mandrel 112 between a first position (FIG. 1A) and a second position (FIG. 3A). Shoulders of the first mandrel section 112*c* may prevent longitudinal movement of the first seat 104 relative to the first mandrel section 112*c*. The first seat 104 has a bore therethrough. The first seat may have a tapered inner surface 104*s* configured to receive an obturating member, such as a ball, dart, or plug. The first seat 104 may be made from an elastomeric material, such as rubber. The inner surface 104*s* may be configured to allow a first dart 171 pumped through the crossover tool 100 to pass through the bore and continue through the crossover tool 100. The inner surface 104*s* may elastically deform to allow the first dart 171 to pass through the bore. The inner surface 104*s* may be configured to receive a second dart 172. The second dart 172 may be the same size as the first dart 171. The second dart 172 may land in the first seat 104 and seal the bore. Pressure may be applied to the second dart 172 and first seat 104 to longitudinally move the first mandrel 112. The inner surface 104*s* may elastically deform to allow the second dart 172 to pass through the bore. Alternatively, the first seat 104 may be made from an extrudable material, such as a metal, to allow the darts 171, 172 to pass through the first seat 104.

The second seat 105 is disposed in a recess 105*r* formed in the second mandrel section 114*e*. Shoulders of the second mandrel section 114*e* prevent longitudinal movement of the second seat 105 relative to the second mandrel section. The second seat 105 has a bore therethrough. The second seat 105 may have a tapered inner surface 105*s* configured to receive an obturating member, such as a ball, dart, or plug. The inner diameter of the second seat 105 may be the same size or smaller than the inner diameter of the first seat 104. The second seat 105 may be made from an elastomeric material, such as rubber. The inner surface 105*s* may be configured to receive the first dart 171. The first dart 171 may land in the second seat 105 and seal the bore. Pressure may be applied to the first dart 171 and second seat 105 to longitudinally move the second mandrel 114. The inner surface 105*s* may elastically deform to allow the first dart 171 and the second dart 172 to pass through the bore. Alternatively, the second seat 105 may be made from an extrudable material, such as a metal, to allow the darts 171, 172 to pass through the second seat 105.

The rotary seal 108 may be disposed in a gap formed in an outer surface of the housing 101. One or more upper bypass ports 108*u* and one or more lower bypass ports 108*b* may be formed through a wall of the housing 101 and may straddle the rotary seal 108. The rotary seal 108 may include a directional seal, such as cup seals 108*c*, a sleeve 108*s*, and bearings 108*d*. The seal sleeve 108*s* may be supported from the housing 101 by the bearings 108*d* so that the housing 101 may rotate relative to the seal sleeve 108*s*. A seal may be disposed in an interface formed between the seal sleeve 108*s* and the housing 101. The cup seals 108*c* may be oriented to sealingly engage the casing string in response to a difference in annulus pressure below and above the rotary seal 108.

The bore valve 116 may include an outer body 117*u,m,b*, an inner sleeve 119, a biasing member, such as a compression spring 122, a cam 124, a valve member, such as a ball valve 125, and upper 126*u* and lower 126*b* seats. The sleeve 119 may be disposed in the outer body 117*u,m,b* and longitudinally movable relative thereto. The body 117*u,m,b* may be connected to a lower end of the second mandrel 114, such as by threaded couplings, and have two or more sections, such as an upper section 117*u*, a mid-section 117*m*, and a lower section 117*b*, each connected together, such as by threaded couplings. The spring 122 may be formed in a chamber formed between the sleeve 119 and the mid body section 117*m*. An upper end of the spring 122 may bear against a lower end of the upper body section 117*u* and a lower end of the spring 122 may bear against a spring washer. The ball valve 125 and ball seats 126*u,b* may be longitudinally connected to the inner sleeve 119 and a lower end of the spring washer may bear against a shoulder formed in an outer surface of the sleeve 119. A lower portion of the inner sleeve 119 may extend into a bore of the lower body section 117*b*. The cam 124 may be trapped in a recess formed between a shoulder of the mid body section 117*m* and an upper end of the lower body section 117*b*. The cam 124 may interact with the ball valve 125 by having a cam profile, such as slots, formed in an inner surface thereof. The ball valve 125 may carry corresponding followers in an outer surface thereof and engaged with respective cam profiles or vice versa.

The lower body section 117*b* may also serve as a valve member for the stem valve 118 by having one or more radial ports 117*p* formed through a wall thereof. A stem 128 may be connected to an upper end of the lower housing section 101*j*, such as by threaded couplings, and have one or more radial ports 128*p* formed through a wall thereof. In the reverse bore position, a wall of the lower body section 117*b* may close the stem ports 128*p* and the ball valve 125 may be in the open position. Movement of the piston 114*p* and the second mandrel 114 from the conventional bore position to the reverse bore position may cause an upper end of the stem 128 to engage a lower end of the inner sleeve 119, thereby halting longitudinal movement of the inner sleeve 119, ball valve 125, and spring washer relative to the body sections 117*u,m,b*. As the body sections 117*u,m,b*, continue to travel downward, the relative longitudinal movement of the cam 124 relative to the ball valve 125 may close the ball valve 125 and align the body ports 117*p* with the stem ports 128*p*, thereby opening the stem valve 118. The spring 122 may open the ball valve 125 during movement back to the conventional bore position.

FIGS. 1A-1D illustrate operation of the crossover tool 100 in the conventional bore position. In the conventional bore position, the bore valve 116 is in the open position, the stem valve 118 is in the closed position, and the lower bypass ports 108*b* are aligned with the bypass ports 130*p* of the second mandrel section 114*h*. A mud pump supplies fluid, such as drilling fluid, from the surface and through the bore of the crossover tool 100, through the open bore valve 116, and out of the opposite end of the crossover tool 100 to continue through the LDA. Returns (e.g., drilling fluid and cuttings) flow up the annulus between the crossover tool 100 and the casing string. The returns enter the crossover tool 100 through the lower bypass ports 108*b* and move into the bypass passage 130 through the bypass ports 130*p* of the second mandrel section 114*h*. The returns continue up through an annulus between the second mandrel section 114*g* and the housing sections 101*f-m*, bypassing the rotary seal 108. The returns exit the crossover tool 100 from the upper bypass ports 108*u* and enter the annulus between the casing string and the crossover tool 100 above the rotary seal 108. From here, the returns continue flowing up to the surface.

Figures 2A, 2B, 2C, 2D:
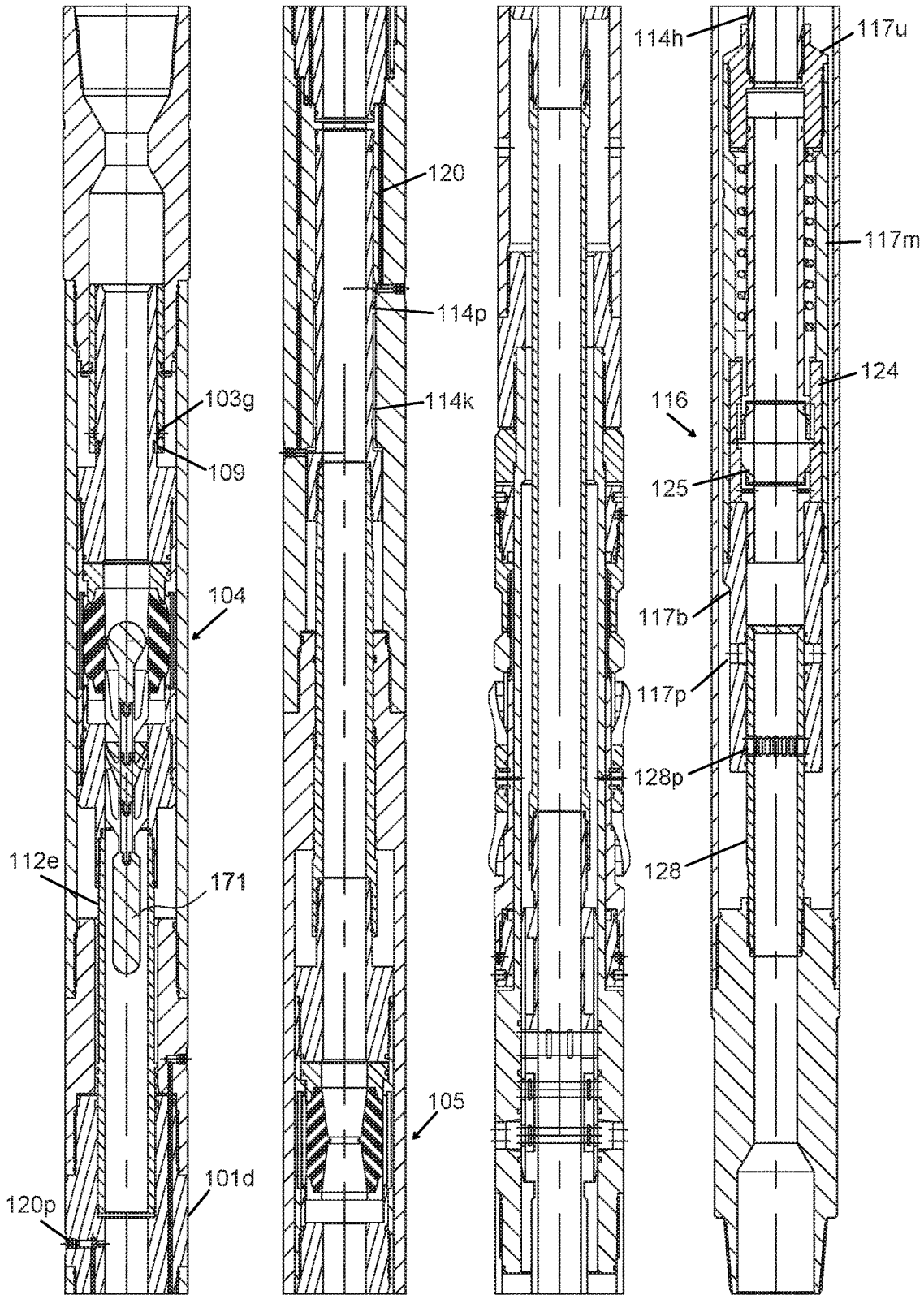
FIGS. 2A-2D illustrate operation of the crossover tool in a conventional bore position.
Figure 3B:
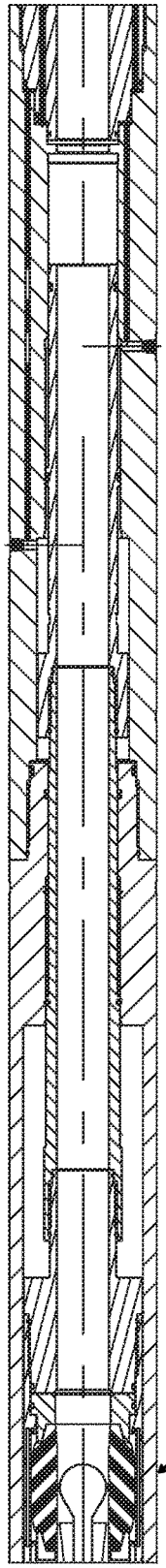
Figure 3C:
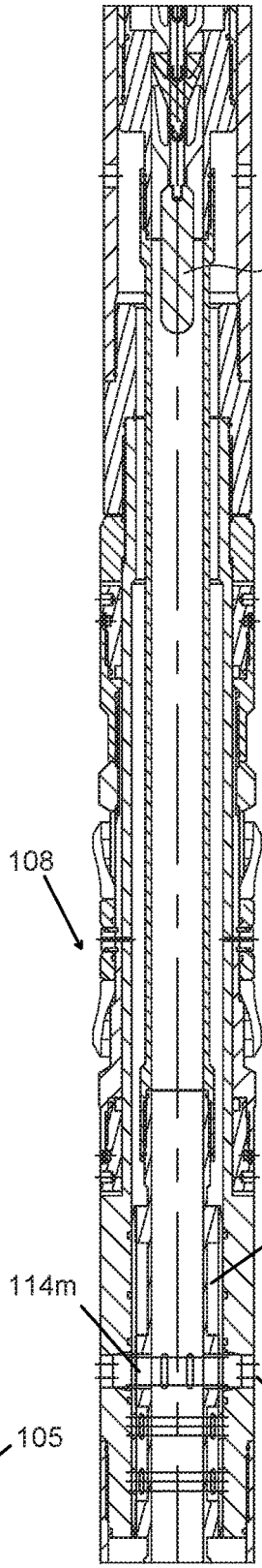
Figure 3D:
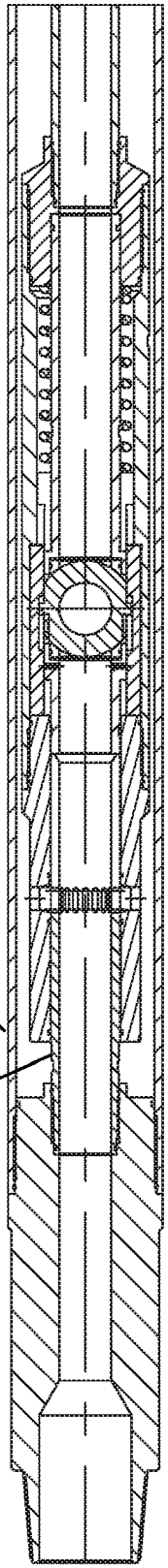
Figures 4A, 4B, 4C, 4D:
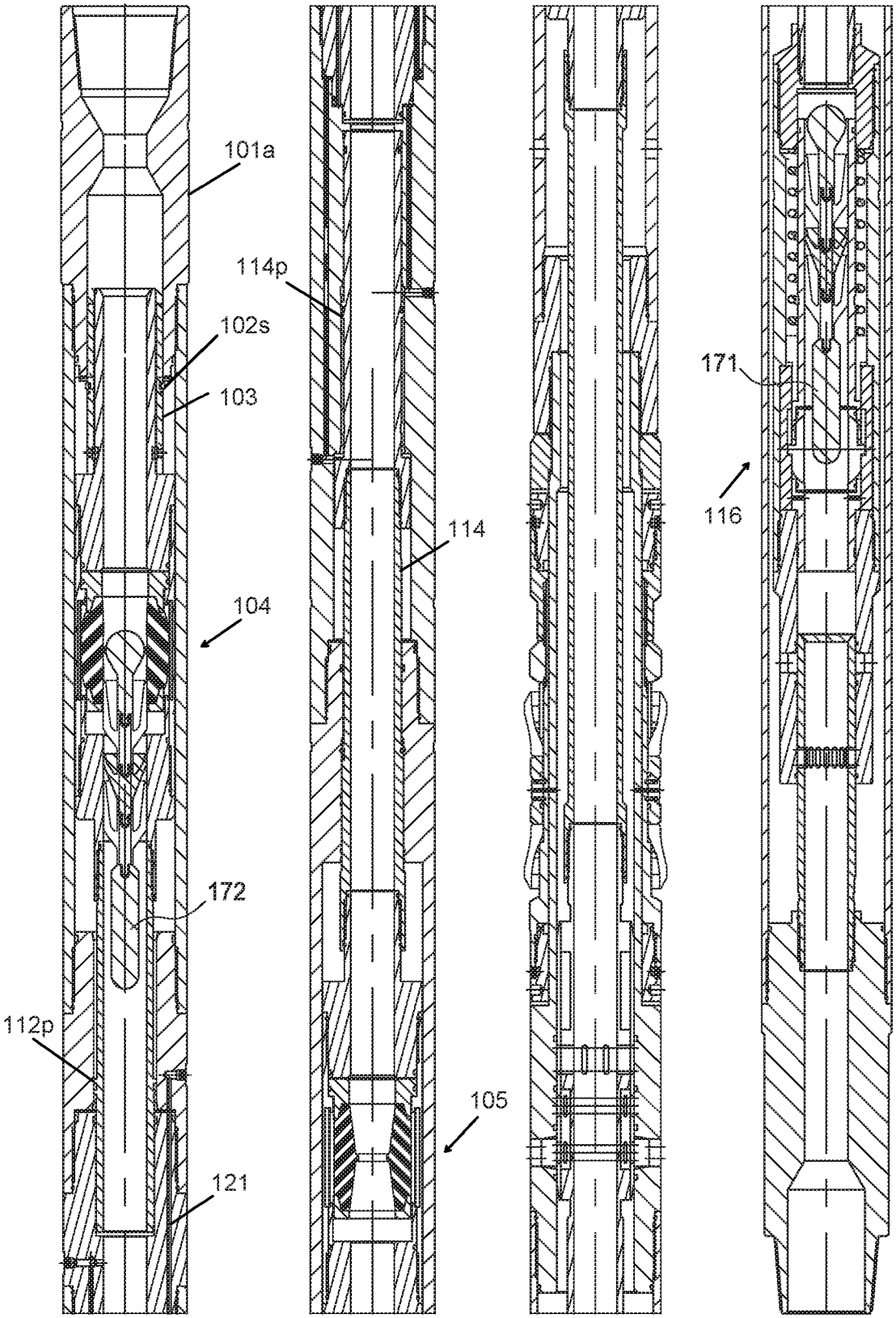
FIGS. 4A-4D illustrate shifting of the crossover tool from the reverse bore position into the conventional bore position.
Figures 5A, 5B, 5C, 5D:
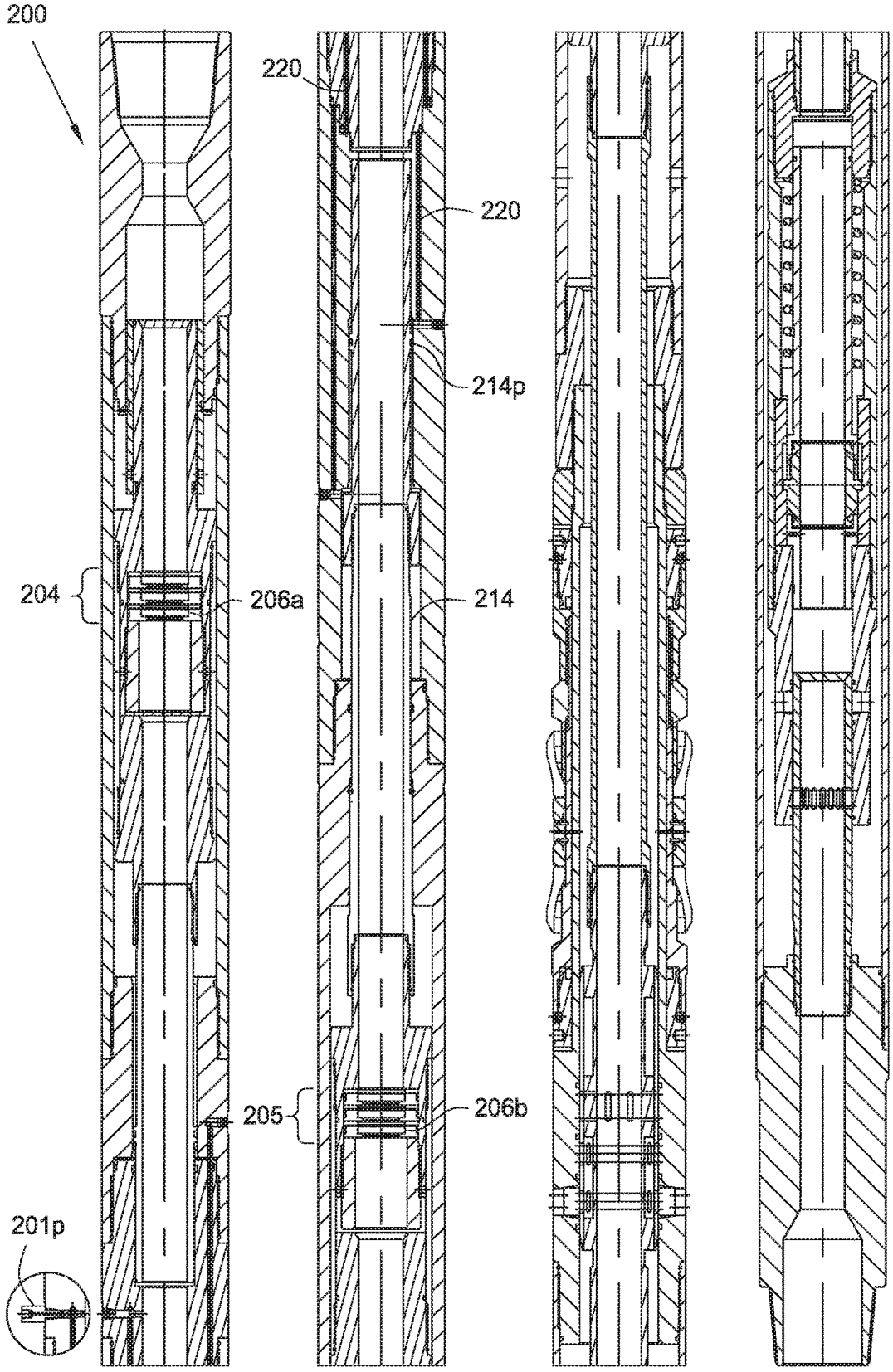
FIGS. 5A-5D illustrate an alternative crossover tool, according to an alternative embodiment of this disclosure.

The crossover tool 100 may be switched to the reverse bore position (FIG. 3A-3D) to cement the liner string in the wellbore. FIGS. 2A-2D illustrate switching the crossover tool 100 from the conventional bore position to the reverse bore position. A cement pump (not shown) may be operated to pump the first dart 171 from the surface down to the crossover tool 100. The first dart 171 is pumped down to the first seat 104 of the crossover tool 100. The shoulder of the housing section 101*d* abuts the first mandrel section 112*e* to prevent longitudinal movement of the first mandrel 112 with the first seat 104 relative to the housing 101. The shoulder of the housing section 101*d* prevents the first dart 171 from longitudinally moving the first mandrel 112 relative to the housing 101 when the first mandrel 112 is in the first position (FIG. 2A). In turn, the fluid pressure acting on the first dart 171 causes the tapered inner surface 104*s* of the first seat 104 to elastically deform. The fluid pressure pushes the first dart 171 through the tapered inner surface 104*s* of the first seat 104. The first dart 171 continues down through the crossover tool 100 until landing in the second seat 105. Pressure applied to the top of the first dart 171 landed in the second seat 105 moves the second mandrel 114 longitudinally relative to the housing 101 to the second position (FIGS. 3B-3D). Meanwhile, fluid pressure in the bore of the crossover tool 100 assists with the movement of the second mandrel 114. Fluid pressure in the bore of the crossover tool 100 pushes against the hydraulic fluid through the port 120*p* connected to the channel 120. The hydraulic fluid in the channel 120 moves into the upper section of the piston chamber 114*k* and acts on the piston 114*p* to cause the piston 114*p* to move downward. In turn, the second mandrel section 114*h* moves the outer body 117*u,m,b* of the bore valve 116 until the inner sleeve 119 abuts the upper end of the stem 128. The radial ports 128*p* of the stem valve 118 align with the radial ports 117*p* of the lower body section 117*b*, opening the stem valve 118 and allowing fluid communication from the bore of the stem 128 to an annulus between the lower body section 117*b* and the housing section 101*i*.

The longitudinal movement of the cam 124 relative to the ball valve 125 closes the bore valve 116. The movement of the second mandrel 114 also moves the mandrel ports 114*m* into alignment with the lower bypass ports 108*b*. In response to the movement of the second mandrel 114, the piston 114*p* pushes hydraulic fluid from the lower section of the piston chamber 114*k* into the channel 121. The hydraulic fluid moves through the channel 121 into the lower section of the piston chamber 112*h*. The pressure of the hydraulic fluid acting on the piston 112*p* causes the first mandrel 112 with the first seat 104 to move longitudinally relative to the housing 101. The first mandrel 112 moves in a longitudinal direction opposite that of the second mandrel 114. Movement of the first mandrel 112 brings the lock ring 109 into alignment with the groove 103*g* in the sleeve 103, causing the lock ring 109 to expand and enter the groove 103*g* in the sleeve 103 and connecting the sleeve 103 to the first mandrel 112. Continued movement of the first mandrel 112 fractures the shear pin 107 connecting the sleeve 103 to the housing section 101*a*. Further longitudinal movement of the first mandrel 112 with the sleeve 103 is prevented by the contact between the shoulder of the housing section 101*a* and the shoulder of the first mandrel section 112*a*.

FIGS. 3A-3D illustrate operation of the crossover tool 100 in the reverse bore position. Once the crossover tool 100 is shifted into the reverse bore position, the first dart 171 passes through the second seat 105. The upper end of the stem 128 prevents further longitudinal movement of the second mandrel 114 downward through the bore of the housing 101. The fluid pressure pushes the first dart 171 through the bore of the second seat 105. The tapered inner surface 105*s* of the second seat 105 elastically deforms to allow the first dart 171 to pass through the bore of the second seat 105. The first dart 171 lands against the closed bore valve 116. The cement behind the first dart 171 flows through the bore of the crossover tool 100. The closed bore valve 116 prevents the cement from flowing through the stem 128. The cement is diverted from the bore of the crossover tool 100 through the mandrel ports 114*m* and the aligned lower bypass ports 108*b* into the annulus between the crossover tool 100 and the casing string and below the rotary seal 108. The cement continues flowing down through the annulus between the casing string and the crossover tool 100, cementing the liner string in the wellbore. The cement displaces the previously pumped drilling fluid. The drilling fluid passes up through the LDA until reaching the lower end of the crossover tool 100. The drilling fluid flows through the open stem valve 118 (via the aligned radial ports 117*p*, 128*p*) and into the annulus between the stem 128 and the housing section 101*n*. The drilling fluid continues up through an annulus between the second mandrel 112 and the housing 101, moving through the bypass passage 130 and bypassing the rotary seal 108. The displaced drilling fluid exits the annulus via the upper bypass ports 108*u* and enters the annulus between the housing 101 and the casing string where it is then conveyed to the surface.

Once the cementing process has finished, the crossover tool 100 may be shifted from the reverse bore position back to the conventional bore position (FIGS. 4A-4D). A second dart 172 is pumped from the surface down to the crossover tool 100. The second dart 172 lands in the tapered inner surface 104*s* of the first seat 104. When the first mandrel 112 and first seat 104 are in the second position (FIG. 3A), the first mandrel 112 is free to move longitudinally downward through the bore of the housing 101. In this position, the shoulder of the sleeve 103 prevents longitudinal movement of the first mandrel 103 upward through the bore of the housing 101. Pressure applied to the second dart 172 landed in the first seat 104 moves the first mandrel 112 longitudinally relative to the housing 101. The lock ring 102*s* of the sleeve 103 moves with the first mandrel 112. The lock ring 102*s* continues moving past the lower end of the housing section 101*a*. After moving past the lower end of the housing section 101*a*, the lock ring 102*s* expands outwards. The lock ring 102*s* then acts as a stop, preventing further longitudinal movement of the first mandrel 112 upward through the bore of the housing 101. The lock ring 102*s* prevents the crossover tool 100 from moving back to the reverse bore position in FIG. 3A-3D. Movement of the first mandrel 112 reverses the hydraulic fluid process described above. In response to the movement of the first mandrel 112, the piston 112*p* pushes hydraulic fluid from the lower section of the piston chamber 112*h* into the channel 121. The hydraulic fluid moves through the channel 121 into the lower section of the piston chamber 114*k*. The pressure of the hydraulic fluid acting on the piston 114*p* causes the second mandrel 114 with the second seat 105 to move longitudinally relative to the housing 101. The second mandrel 114 moves in a longitudinal direction opposite that of the first mandrel 112. The inner tapered surface 104*s* elastically deforms to allow the second dart 172 to pass through the bore of the first seat 104. The first and second darts 171, 172 are pumped through the bore valve 116 and out of the crossover tool 100.

FIGS. 5A-5D illustrate an alternative embodiment of the crossover tool. Crossover tool 200 includes a first seat stack 204 and a second seat stack 205. The first seat stack 204 and the second seat stack 205 replace the first seat 104 and second seat 105, respectively, of the crossover tool 100. The seat stacks 204, 205 may have one or more seats 206*a,b*. The seats 206*a,b* may be configured to receive an obturating member, such as a plug, ball, or a dart, such as first dart 171. The seats 206*a,b* may be extrusion plates. The seats 206*a,b* may be made from an extrudable material, such as a metal. The seat 206*b* may have an inner diameter the same size or smaller than the inner diameter of the seat 206*a*. A first obturating member may be sized to pass through the inner diameter of the seat and land in the second seat stack. The first obturating member may be pumped from the surface to the crossover tool 200 and through the first seat stack 204. The first obturating member may land in the second seat stack 205 to move the crossover tool 200 from the conventional position to the reverse bore position. The crossover tool 200 may be operated in the same manner as the crossover tool 100 described above. A second obturating member may be pumped from the surface to the crossover tool 200. The second obturating member may be sized to land in the first seat stack 204. The second obturating member may have an outer diameter greater than the outer diameter of the first obturating member. The second obturating member may land in the first seat stack 204 to move the crossover 200 from the reverse bore position back to the conventional position. The crossover tool 200 may be operated in the same manner as the crossover tool 100 described above.

Alternatively, the crossover tools 100, 200 may be moved into the reverse bore position before running the crossover tool into the casing string. A housing section may have a port 201*p* formed in a wall thereof. The port 201*p* may be in fluid communication with a channel 220, similar to the channel 120 described above. A pump may be connected to the port 201*p*. Fluid may be pumped through the port 201*p* and into the channel 220. The fluid may act on a piston 214*p* to move the second mandrel 214 and shift the crossover tool 200 into the reverse bore position as described above with respect to crossover tool 100. The crossover tools 100, 200 may then be run into the casing string in the reverse bore position.

In one or more of the embodiments described herein, a crossover tool for use in a wellbore may include a tubular housing having a bypass port. The crossover tool may include a mandrel having a bore therethrough and a mandrel port in fluid communication with the mandrel bore. The mandrel may be movable relative to the tubular housing between a first position where the mandrel port is isolated from the bypass port and a second position where the mandrel port is aligned with the bypass port. An actuator may be operable to move the mandrel between the first position and the second position. The actuator may include a first piston connected to the mandrel and a second piston operable in response to the first piston.

In one or more of the embodiments described herein, a crossover tool for use in a wellbore includes a tubular housing having a bypass port. The crossover tool may include a first mandrel having a bore therethrough. The first mandrel may include a mandrel port, a first seat, and a first piston. The first piston may be movable in a first direction between a first position where the mandrel port is isolated from the bypass port and a second position where the mandrel port is aligned with the bypass port and movable in response to the first seat receiving a first fluid blocking member. The crossover tool may include a second mandrel having a bore therethrough. The second mandrel may include a second seat and a second piston movable in a second direction in response to the first piston.

In one or more of the embodiments described herein, the mandrel includes a first seat operable to actuate the actuator.

In one or more of the embodiments described herein, the crossover tool includes a second mandrel having a bore therethrough and connected to the second piston.

In one or more of the embodiments described herein, the crossover tool includes a second seat connected to the second mandrel and operable to actuate the actuator.

In one or more of the embodiments described herein, the first seat and second seat are configured to receive an obturating member.

In one or more of the embodiments described herein, an inner diameter of the first seat is the same or smaller than an inner diameter of the second seat.

In one or more of the embodiments described herein, the first seat and the second seat are made from an extrudable or elastomeric material.

In one or more of the embodiments described herein, the second piston is movable in a direction opposite of a direction of the first piston.

In one or more of the embodiments described herein, the first seat and the second seat includes a seat stack having one or more seats.

In one or more of the embodiments described herein, the mandrel includes a mandrel bypass port.

In one or more of the embodiments described herein, the mandrel bypass port is aligned with the bypass port of the tubular housing when the mandrel is in the first position.

In one or more of the embodiments described herein, the mandrel bypass port is in fluid communication with a bypass passage of the mandrel.

In one or more of the embodiments described herein, a method for cementing a liner string in a wellbore may include running a liner string and a crossover tool into the wellbore. The crossover tool may include a first seat, a first mandrel having a first piston and a mandrel port, and a second piston. The method may include landing a first obturating member in the first seat. The method may include supplying pressure to a bore of the crossover tool to move the first piston. The method may include: moving the second piston in response to movement of the first piston and shifting the crossover tool from a first position to a second position in response to landing the first obturating member in the first seat. The mandrel port may be isolated from a bypass port in the first position. The mandrel port may be aligned with the bypass port in the second position. The method may include pumping cement through the crossover tool and into an annulus between the liner string and the wellbore.

In one or more of the embodiments described herein, a bore of the crossover tool is closed in the second position.

In one or more of the embodiments described herein, the method includes landing a second obturating member in a second seat connected to the second piston.

In one or more of the embodiments described herein, the method includes supplying pressure to the bore of the crossover tool to move the second piston.

In one or more of the embodiments described herein, the method includes moving the first piston in response to movement of the second piston.

In one or more of the embodiments described herein, the method includes shifting the crossover tool from the second position to the first position.

In one or more of the embodiments described herein, the pumped cement enters the annulus between the liner string and the wellbore by moving through the mandrel port and the bypass port.

In one or more of the embodiments described herein, the method includes moving a bore valve of the crossover tool to a closed position in response to landing the first obturating member in the first seat.

In one or more of the embodiments described herein, the method includes moving a stem valve of the crossover tool to an open position in response to landing the first obturating member in the first seat.

In one or more of the embodiments described herein, a bore of the stem valve is in fluid communication with a bypass passage of the first mandrel when the stem valve is in the open position.

In one or more of the embodiments described herein, the method includes moving the bore valve to an open position in response to landing the second obturating member in the second seat.

In one or more of the embodiments described herein, and the method may include moving the stem valve to a closed position in response to landing the second obturating member in the second seat.

In one or more of the embodiments described herein, the method includes receiving drilling fluid through the open stem valve after shifting the crossover tool to the second position.

While the foregoing is directed to embodiments of the present disclosure, other and further embodiments of the disclosure may be devised without departing from the basic scope thereof, and the scope of the invention is determined by the claims that follow.

The invention claimed is:

1. A crossover tool for use in a wellbore, comprising:
- a tubular housing having a bypass port;
- a mandrel having a bore therethrough and a mandrel port in fluid communication with the mandrel bore, the mandrel movable relative to the tubular housing between a first position where the mandrel port is isolated from the bypass port and a second position where the mandrel port is aligned with the bypass port;
- an actuator operable to move the mandrel between the first position and the second position, comprising:
  - a first piston connected to the mandrel; and
  - a second piston operable in response to the first piston; and
- a first seat disposed in the mandrel and operable to actuate the actuator.

2. The crossover tool of claim 1 further comprising: a second mandrel having a bore therethrough and connected to the second piston; and a second seat connected to the second mandrel and operable to actuate the actuator.

3. The crossover tool of claim 2, wherein:
- the first seat and the second seat are configured to receive an obturating member;
- an inner diameter of the first seat is the same or smaller than an inner diameter of the second seat; and
- the first seat and the second seat are made from an extrudable or elastomeric material.

4. The crossover tool of claim 2, further comprising a third seat to form a first seat stack with the first seat and wherein an inner diameter of the third seat is the same or smaller than an inner diameter of the first seat.

5. The crossover tool of claim 1, wherein the second piston is movable in a direction opposite of a direction of the first piston.

6. The crossover tool of claim 1, wherein the mandrel further comprises a mandrel bypass port and wherein the mandrel bypass port is aligned with the bypass port of the tubular housing when the mandrel is in the first position.

7. The crossover tool of claim 6, wherein the mandrel bypass port is in fluid communication with a bypass passage of the mandrel.

8. A crossover tool for use in a wellbore, comprising:
- a tubular housing having a bypass port;
- a first mandrel having a bore therethrough and comprising:
  - a mandrel port;
  - a first seat; and
  - a first piston movable in a first direction between a first position where the mandrel port is isolated from the bypass port and a second position where the mandrel port is aligned with the bypass port and movable in response to the first seat receiving a first fluid blocking member; and
- a second mandrel having a bore therethrough and comprising:
  - a second seat; and
  - a second piston movable in a second direction in response to the first piston.

9. The crossover tool of claim 8, further comprising a third seat to form a first seat stack with the first seat and wherein an inner diameter of the third seat is the same or smaller than an inner diameter of the first seat.

10. The crossover tool of claim 8, wherein the second direction is opposite of the first direction.

11. The crossover tool of claim 8, wherein:
- the first seat and the second seat are configured to receive an obturating member;
- an inner diameter of the first seat is the same or smaller than an inner diameter of the second seat; and
- the first seat and the second seat are made from an extrudable or elastomeric material.

12. The crossover tool of claim 8, wherein the first mandrel further comprises a mandrel bypass port and wherein the mandrel bypass port is aligned with the bypass port of the tubular housing when the first piston is in the first position.

13. A method for cementing a liner string in a wellbore, comprising:
- running a liner string and a crossover tool into the wellbore, the crossover tool comprising:
  - a first seat;
  - a first mandrel having a first piston and a mandrel port; and
  - a second piston;
- landing a first obturating member in the first seat;
- supplying pressure to a bore of the crossover tool to move the first piston;
- moving the second piston in response to movement of the first piston;

shifting the crossover tool from a first position to a second position in response to landing the first obturating member in the first seat, wherein:

the mandrel port is isolated from a bypass port in the first position; and the mandrel port is aligned with the bypass port in the second position; and pumping cement through the crossover tool and into an annulus between the liner string and the wellbore.

14. The method of claim 13, wherein a bore of the crossover tool is closed in the second position.

15. The method of claim 13, further comprising:

landing a second obturating member in a second seat connected to the second piston;

supplying pressure to the bore of the crossover tool to move the second piston;

moving the first piston in response to movement of the second piston; and shifting the crossover tool from the second position to the first position.

16. The method of claim 15, further comprising:

moving a bore valve of the crossover tool to a closed position in response to landing the first obturating member in the first seat; and moving a stem valve of the crossover tool to an open position in response to landing the first obturating member in the first seat, wherein a bore of the stem valve is in fluid communication with a bypass passage of the first mandrel when the stem valve is in the open position.

17. The method of claim 16, further comprising:

moving the bore valve to an open position in response to landing the second obturating member in the second seat; and moving the stem valve to a closed position in response to landing the second obturating member in the second seat.

18. The method of claim 16, further comprising:

after shifting the crossover tool to the second position, receiving drilling fluid through the open stem valve.

19. The method of claim 13, wherein the pumped cement enters the annulus between the liner string and the wellbore by moving through the mandrel port and the bypass port.

20. The method of claim 13, wherein the obturating member is selected from the group consisting of a ball, a dart, and a plug.

* * * * *